United States Patent [19]

Kirby

[11] Patent Number: 5,054,788

[45] Date of Patent: Oct. 8, 1991

[54] BOARD GAME

[76] Inventor: Agnes L. Kirby, 2409-16 Street, Box 547, Nanton, Alberta, Canada, T011R0

[21] Appl. No.: 413,062

[22] Filed: Sep. 27, 1989

[51] Int. Cl.[5] ..... A63F 3/00

[52] U.S. Cl. ..... 273/272; 273/299

[58] Field of Search ..... 273/272, 299

[56] References Cited

U.S. PATENT DOCUMENTS

| | | | |
|---|---|---|---|
| 1,633,445 | 6/1927 | Gail et al. | 273/272 |
| 2,320,832 | 6/1943 | Schoenberg et al. | 273/272 |
| 2,743,108 | 4/1956 | Sanders | 273/272 |
| 2,766,987 | 10/1956 | Seelbrede et al. | 273/272 |
| 4,055,347 | 10/1977 | Kreisher | 273/272 |

FOREIGN PATENT DOCUMENTS

| | | | |
|---|---|---|---|
| 1208246 | 2/1960 | France | 273/272 |

OTHER PUBLICATIONS

"Scrabble", *Playthings*, 1956, p. 4.

*Primary Examiner*—Edward M. Coven
*Assistant Examiner*—William M. Pierce
*Attorney, Agent, or Firm*—H. Jay Speigel

[57] ABSTRACT

The present invention relates to an improved board game played on a board with a multiplicity of circular spaces printed thereon. Some of the spaces have indicia such as the face of a character forming the basis of the game. Other spaces have other information thereon such as information concerning scoring and the choosing of cards or chips. The object of the game is to build words out of letter chips and thereby to score the most points.

3 Claims, 2 Drawing Sheets

FIG. 1
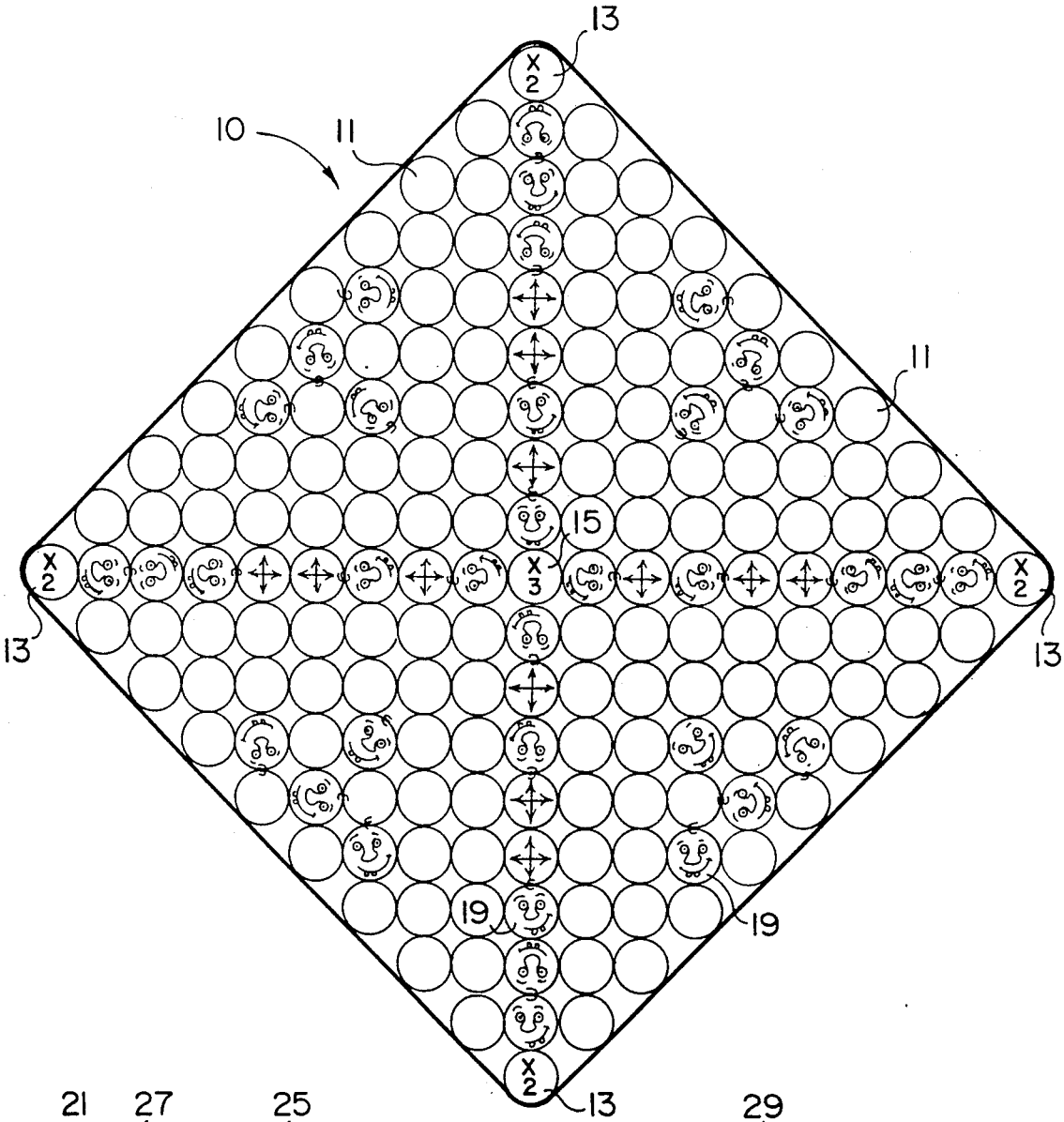
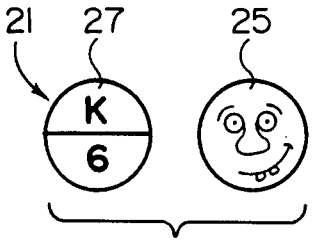
FIG. 2
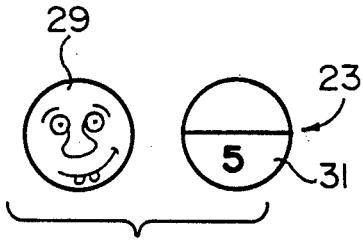
FIG. 3

BOARD GAME

BACKGROUND OF THE INVENTION

The present invention relates to an improved board game. In the prior art, board games whose purpose is to build words using letter chips of differing values are known. British Patent Specification No. 775,170 to Kemp and British Patent Specification No. 938,593 to Bunker disclose this type of board game. However, applicant is unaware of any board game which includes all of the features and aspects of the present invention.

SUMMARY OF THE INVENTION

The present invention relates to an improved board game. The present invention includes the following interrelated aspects and features:

(a) In a first aspect, the inventive board game is played on a board of generally square configuration having, preferably, one hundred and eighty-one spaces thereon, including two overlapping matrices of spaces, one of which is ten spaces by ten spaces, and the other of which is nine spaces by nine spaces.

(b) The spaces are preferably circular in configuration and most of them have no printing thereon. Others have arrow indicia thereon for purposes to be described in greater detail hereinafter and, similarly, other spaces have a face thereon meant to resemble a fictional character known as a "Scroyle", which character is involved in the inventive game. Other spaces have other markings which determine scoring, etc.

(c) The game equipment includes a plurality of letter chips having a Scroyle face on one side and, on the other side, a letter of the alphabet along with the number of points attributed to that letter when used in forming a word on the inventive board.

(d) Other features of the game include the use of cards known as "Royle Scroyle" cards.

(e) The intended object of the game is for players to form words using letters and to add up scoring based upon the point value attributable to each such letter. At the conclusion of the game, the player with the most points is declared the winner.

Accordingly, it is a first object of the present invention to provide an improved board game.

It is a further object of the present invention to provide such a board game wherein words may be formed using letter chips wherein each letter has a different scoring value.

It is a still further object of the present invention to provide such an improved board game wherein other cards may be randomly chosen during the playing of the game.

It is a still further object of the present invention to provide such a board game wherein the board thereof has various printed features thereon which are incorporated into the playing of the game.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows a top view of the board of the present invention.

FIG. 2 shows the front and back of an example of a letter chip.

FIG. 3 shows the front and back of a blank chip.

SPECIFIC DESCRIPTION OF THE PREFERRED EMBODIMENT

Figure 4:
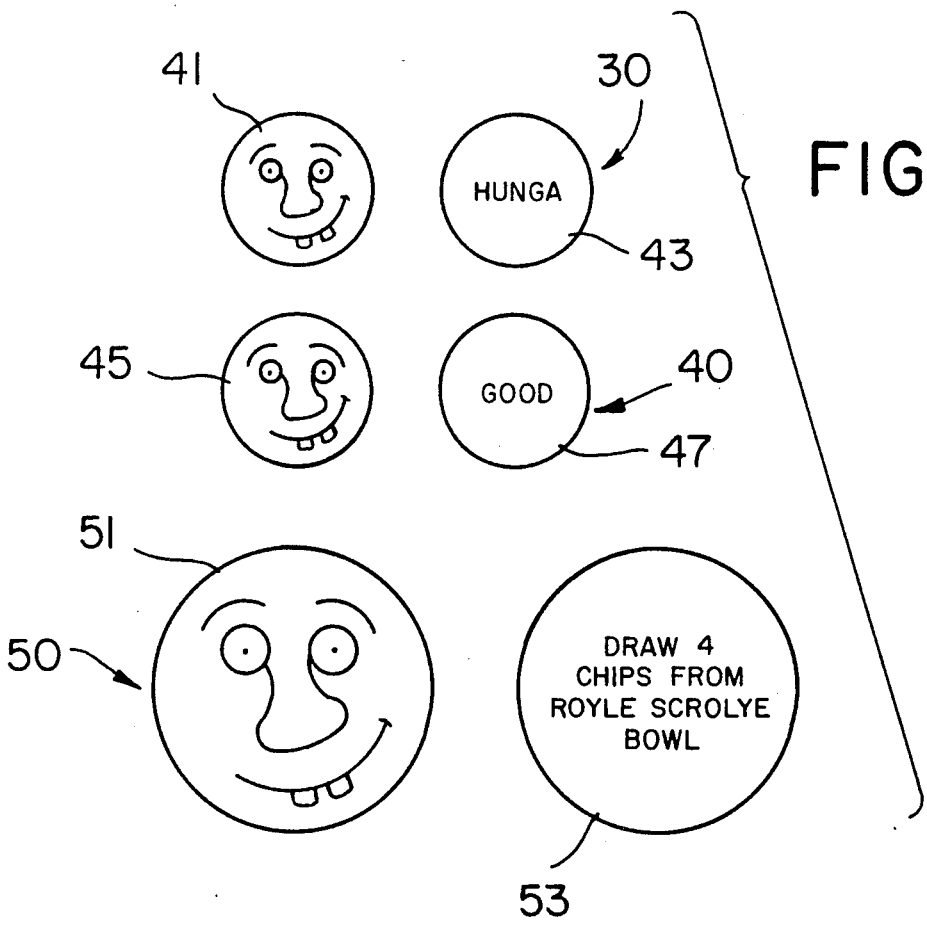
FIG. 4 depicts the front and back of an example of an instruction card and another type of chip.

With reference to FIG. 1, the inventive game board is generally designated by the reference numeral 10 and is seen to include, preferably, 181 spaces including one matrix of 10 spaces by 10 spaces overlapped by one matrix of 9 spaces by 9 spaces. As shown, the spaces 11 are blank, the corner spaces 13 have printed thereon "X2", the center space 15 has printed thereon "X3", other spaces 17 have crossed arrows thereon, and still further spaces 19 have a caricature of a face printed thereon which is intended to resemble a fictional character known as a "Scroyle".

In the preferred embodiment of the inventive game board 10, there are thirty-six spaces 19, twelve spaces 17, four spaces 13, one space 15, and the remainder of the spaces are blank.

With reference to FIGS. 2 and 3, playing chips including a letter chip 21 and a blank chip 23 are respectively shown. As shown in FIG. 2, the letter chip 21 includes one side 25 having a Scroyle face thereon and another side 27 having printed thereon a letter, in this case the letter "K", and a number, in this case the number "6" which is intended to denote the scoring value of the use of the letter "K" in creating a word. The blank chip 23 includes a side 29 having a Scroyle face thereon as well as a side 31 having a blank region with the number "5" thereon. In playing the game, blank chips may be used to denote any letter and are given the scoring value printed on the face 31 thereof.

In the preferred embodiment of the present invention, fourteen blank chips, each worth five points are provided and, additionally, letter chips for each letter of the alphabet are provided with the number of chips and their point values being displayed in Table A below.

TABLE A

| LETTER | NUMBER OF CHIPS | POINT VALUE EACH |
|---|---|---|
| E | 13 | 1 |
| T | 8 | 2 |
| A | 8 | 2 |
| O | 8 | 2 |
| N | 8 | 2 |
| I | 7 | 3 |
| R | 7 | 3 |
| S | 7 | 3 |
| D | 5 | 4 |
| L | 5 | 4 |
| H | 5 | 4 |
| G | 5 | 4 |
| U | 4 | 4 |
| C | 3 | 5 |
| M | 3 | 5 |
| P | 3 | 5 |
| W | 3 | 5 |
| B | 3 | 5 |
| F | 3 | 5 |
| V | 2 | 6 |
| Y | 2 | 6 |
| K | 2 | 6 |
| J | 2 | 6 |
| Q | 1 | 6 |
| X | 1 | 7 |
| Z | 1 | 7 |

Additional chips are included in the inventive game and are known as "Scroyle Hoyle" chips. In the preferred embodiment of the present invention, there are four types of Scroyle Hoyle chips, each of which has, on one face thereof, a Scroyle face which looks mischievous. These four types of Scroyle Hoyle chips are: (1) a blank chip with a numerical value of five points of which fourteen are included; (2) sixteen letter chips representing the letters, quantities and point values in Table B below; (3) Good Scroyle chips; and (4) Hunga Scroyle chips, of which there are three chips. In the game, "HUNGA" is an abbreviation for the combination of letters "HORIDUGLINERDIGROSIAWFULA".

TABLE B

| LETTER | NUMBER OF CHIPS | POINT VALUE EACH |
|---|---|---|
| Z | 3 | 7 |
| X | 3 | 7 |
| Q | 2 | 6 |
| J | 2 | 6 |
| K | 2 | 6 |
| Y | 2 | 6 |
| V | 2 | 6 |

Each Good Scroyl chip may be used to give a player drawing this chip an extra turn. Each Hunga Scroyle chip, when drawn by a player, causes a deduction of twenty-five points from that player's point total.

The Royle Scroyle Cards: These circular playing cards are larger than the circular playing chips. They are preferably orange with black printing on them. On their back side is printed the mischievous "Scroyle" face. On their face side is printed individual "consequence instructions". There are thirty-six Royle Scroyle cards in total, eighteen entitled "Royle Pains", and eighteen, entitled "Royle Pleasure".

FIG. 4 shows an example of a Hunga Scroyle Chip, a Good Scroyle Chip and a Royle Scroyle Card. As can be seen from the drawing, the Hunga Scroyle Chip 30 includes one side 41 with a Scroyle face thereon and another side 43 having printed thereon "Hunga". The Good Scroyle Chip 40 has on one side 45 thereof a Scroyle face thereon and another side 47 having printed thereon the word "Good". The Royle Scroyle card 50 includes one side 51 having a Scroyle face thereon with the other side 53 having printed thereon an exemplary instruction "draw 4 chips from the Scroyle Hoyle bowl".

The eighteen Royle Pain Royle Scroyle cards have the following respective consequence instructions:

"Place any six of your letter chips having a number value of 5 or more into the Scroyle Hoyle Bowl."

"Draw 6 letter chips from the Scroyle Hoyle Bowl. If among these 6 letter chips there is a HUNGA Scroyle, subtract 25 from total score—if not, subtract total of chips drawn."

"Put three of your vowel chips into the Scroyle Hoyle Bowl. If you have fewer than 3 vowel chips, place all of them in the Scroyle Hoyle Bowl."

"Player on your left must select 4 of your letter chips which he may choose to keep or place in the Scroyle Hoyle Bowl."

"Use as many of your letter chips as possible to form as closely as you can the word "HORIDUGLINERDIGROSIAWFULA". Multiply word score by 2 and subtract from total. Place 5 letter chips from the word into the Scroyle Hoyle Bowl."

"Count the number of Board Scroyles that have been covered by a letter chip and multiply that number by 5. Subtract the result from total score."

"Count the number of uncovered board corner spaces marked "2X" and multiply by 20. Subtract that number from your total score."

"Give one-half of your total score to the player on your right. Note: Add 1 point to odd-numbered scores before dividing the total score by 2."

"Count the number of board Scroyles that have not been covered with a letter chip and multiply that number by 3. covered with a letter Subtract result from total score."

"Player to your left must, if possible, form a word using your letter chips to do so; word score is then added to their total."

"Player to your right must give you 3 letter chips of their choice. And the total of these chips and multiply the total by 5. Subtract this number from your total score."

"If you have any blanks, give them to the player on your right."

"Double the score of the word you have just formed and subtract it from your total score."

"Place six consonant letter chips into the Scroyle Hoyle Bowl. If you have fewer than six consonant letter chips, place all of them in the Scroyle Hoyle Bowl."

"If the word you have just formed contains either an "A" or an "E", subtract the word score from your total."

"Subtract 50 points from your total score."

"Place six of your vowel letter chips into the Scroyle Hoyle Bowl. If you have fewer than six vowel letter chips, place all of them in the Scroyle Hoyle Bowl."

"Sorry. Your total score is now 25."

The eighteen Royle Pleasure Royle Scroyle Cards have the following respective consequence instructions:

"Select 4 letter chips of your choice from any player or players. Using selected chips and any of your chips, form a word."

"Draw 4 chips from the Scroyle Hoyle Bowl."

"Spell it your way! How? Form a word using up to 3 letters incorrectly. Announce the word which was intended. (2 such chips)."

"Add 20 to your total word score."

"Draw 3 chips from the Scroyle Hoyle Bowl. (3 such chips)."

"Draw 4 chips from the Scroyle Hoyle Bowl. (2 such chips)."

"Draw 5 chips from the Scroyle Hoyle Bowl. (3 such chips)."

"Double the score of the word you have just formed and add to your total."

"HORIDUGLINERDIGROSIAWFULA: Form the above word using your own letter chips and those of any other player, if needed. Word may change direction of play and any portion of it. Add total word score to total."

"If you can form a word containing a "Y", "P", "Q", or "X", do so. Double the word score and add it to your total."

"If your total score is greater than zero, double your total score. If your total score is less than zero, it now becomes 75."

"Triple the score of the word you have just formed and add to your total."

As should be understood, when one of the Royle Scroyle Cards described above is chosen in the course of playing the game, the instructions printed thereon must be followed.

The Scroyle Hoyle Bowl is a container in which playing chips are placed. The score is preferably kept on a paper pad which has two columns for each player: in one column the total numerical points is tallied and in the other column, a tally is kept of the number of Scroyle spaces 19 covered. A timer is preferably provided, which may be set to four minutes, for example, and which buzzes or emits some other indication at that time.

The object of the invention is to win by accumulating the highest total score at the conclusion of the game. How to play:

1. Set up (a) Determine who will be the Scorekeeper. This may be done either by the mutual consent of the players or by each player drawing a chip from the Scroyle Hoyle Bowl wherein are stored all the letter chips and Scroyle Hoyle chips. The player drawing the chip which is closest to the beginning of the alphabet is the Scorekeeper. In the event that two players draw the same "closest-to-the-beginning-of-the-alphabet chip", they must draw an additional chip to determine which of them is the Scorekeeper.

(b) The Scorekeeper sets up the game by:

1. placing the board in the center of the players with its outside corner circles (marked 2X) facing each player;
2. shuffling the Royle Scroyle Cards and placing them to his right back side up; and
3. shaking the Scroyle Hoyle Bowl which contains the preferably red Scroyle Hoyle chips and the preferably magenta playing letter chips and by placing the Scroyle Hoyle Bowl to his right.

2. Determining who is the Beginning Player by the following instructions:

All players draw 4 chips from the Scroyle Hoyle Bowl. The first player to form a four-letter word is the Beginning Player. In the event that no player can form a four-letter word with the chips they have drawn, all chips are returned to the Scroyle Hoyle Bowl and the bowl is reshaken and another four chips are drawn by each player until a word can be formed.

3. All players now assist the Scorekeeper in separating the magenta playing letter chips from the red Scroyle Hoyle chips. The magenta chips are returned to and placed face up to the Scorekeeper's right while the red chips are returned to and left in the Scroyle Hoyle Bowl which the Scorekeeper then shakes well and places on his right hand side.

4. The Beginning Player starts the game by choosing a magenta chip of his choice.

5. The Player to the right of the Beginning Player continues the game by choosing a magenta chip of his choice and the Player to his right then chooses a magenta chip, and this sequence continues until all of the magenta playing letter chips are chosen. Players then arrange their playing letter chips in alphabetical order (same letters are stacked on top of each other) to their left.

6. The Scorekeeper sets the four-minute timer.

7. The Beginning Player commences play by building a word of any length with his playing letter chips. This word is placed on the board by covering the circular spaces with the playing letter chips. The word formed must be placed to cover any circular space marked 3X or 2X, or it may be placed on any circular space in a straight line as long as the end and start chips reach from an outside edge of the board to another outside edge thereof. In the event that the word formed is placed upon the circular space marked 3X, the player triples his word score. In the event that the word formed is placed upon the circular space marked 2X, the player doubles his word score and, in the event that the word formed is placed from an outside edge to an outside edge, the player doubles his word score. The Scorekeeper then tallies the total numerical word score and tallies the total number of Scroyle face spaces which have been covered by the play. The Scorekeeper continues to draw the top Royle Scroyle Card and read it aloud. The player then obeys the directions on the Royle Scroyle Card. The Scorekeeper then discards that Royle Scroyle Card face up to his left. The Scorekeeper continues to daw and read the next Royle Scroyle Card which the Player obeys. This routine is repeated until the total amount of cards drawn corresponds to the number of Scroyle face Spaces covered on the board by forming of player's word. (e.g., Player has covered four Scroyle face spaces, then four Royle Scroyle Cards must be drawn one by one by the Scorekeeper and obeyed one by one by the player and discarded one by one by the Scorekeeper). If Players fail to build a word in the four-minute time limit, subtract 20 points from his total score. Note: beginning score may be a minus quantity, e.g., −20, etc.

8. The Player to the Beginning Player's right continues to play by building a word within the four-minute time limit (the Scorekeeper resets the timer as soon as the Beginning Player'score has been tallied and all the Royle Scroyle card consequences obeyed—it should be noted that the time limit for any word building resulting from consequences to be obeyed, is limited to three minutes (as set by the Scorekeeper on the timer) and if not built within this time frame, the Player to the right may build a word using the current Player's chips and the total of that word counts against the current Player's total score. The word built must:

(a) join in crossword style to the word of the previous Player, or (b) stretch from one outside board circle to another outside board circle in the appropriate direction of play. Note: Direction of play is indicated by arrows. It would also be noted that in building a word which involves covering a directional arrow circle, the player may choose to change the direction of the word built at that point; however, such a word must be a word formed according to either 8(a) or 8(b) above. The Scorekeeper then tallies the total score and draws and reads the appropriate number of Royle Scroyle Cards which the player obeys.

9. The next player to the right takes his or her turn in the same manner.

10. The game proceeds in this manner until one player is out of letter chips, or it has become impossible for any player to form a word.

11. At this point, the final play is declared. The final play consists of each player drawing two chips from the Scroyle Hoyle Bowl. The numerical values of these chips are then added to each player's total score. If a Good Scroyle is drawn, the player is excused from deducting the total of the unused chips when tabulating final total score. If a Hunga Scroyle is drawn, the player must deduct 25 from his final total score and also deduct the total of the unused chips he has remaining from his total score (all players must deduct the total of the chips they have remaining from their total score except in the event that they have drawn a Good Scroyle). In the event that both a Hunga Scroyle and a Good Scroyle are drawn by a player, that player's final score does not have any alterations but remains as it is.

Examples of final score calculations

A. Player's score is 150.

Player draws chips with a value of 5 and 1 (total=6).

Player's score is now 156.

Player's unused letter chips must be tallied and subtracted from total, e.g., should a player retain 2 letter chips having a value of 7 each, and 2 letter chips having a value of 5 each and 1 letter chip having a value of 4, he must subtract 27 from 156 and his final total score is 129.

B. Player's score is 150.

Player draws chips with a value of 7 and also a Good Scroyle.

Player is excused from deducting the 7 from his score because of the Good Scroyle.

Player is excused from deducting his unused chips with a value of 2—7s, 2—5s, and 1—4; because of the Good Scroyle.

Player's final total score is 150.

C. Player's score is 150.

Player draws chips with a value of 4 and a Hunga Scroyle.

Player must deduct 4 from his score leaving a total of 146.

Player must deduct 25 from his score because of the Hunga Scroyle leaving a total of 121.

Player must deduct the numerical sum of his unused chips (27) from his total.

Player's final score is 94.

D. Player's score is 150.

Player draws a Hunga Scroyle and a Good Scroyle.

No alterations to score are made.

Do not deduct total of unused chips.

Player's final score is 150.

Special Rules

There 2 types of Royle Scroyle Cards marked "HORIDUGLINERDIGROSIAWFULA".

1. Royle Scroyle card marked "HORIDUGLINERDIGROSIAWFULA" (Royle Pleasure). Such a card is special in that the player drawing one such card must, providing he has appropriate letters to do so, form the word "HORIDUGLINERDIGROSIAWFULA", (or any portion of it) providing he uses an existing word in place on the board to build from in crossword style. The direction of the word may be changed at any point in the word as illustrated in Diagram A.

2. Royle Scroyle (Royle Pain) Cards marked "HORIDIUGLINERDIGROSIAWFULA": The player drawing such a card must form the word "HORIDUGLINERDIGROSIAWFULA," or any portion of it possible but cannot change direction of play. The letters must be laid in the correct spelling sequence. Example: The player has only some of the letters found in the word "HORIDUGLINERDIGROSIAWFULA" and they are "HORIDGLNER". He may either lay these letters down crossword style to an existing word or, if there is an appropriate space where the fist letter and the last letter will each to the outside circle spaces, place them there.

All words build throughout the entire game must:

(a) join in crossword style to the word of the previous player, or (b) stretch from one outside board circle to another outside board circle in the appropriate direction of play, or (c) cover either a 2X or a 3X space.

DIAGRAM "A":

| Correct: | Correct: | Break off: Incomplete Word |
|---|---|---|
| w<br>Handsome<br>o tamer<br>ridug e<br>l a s<br>iner l t<br>d u<br>i f<br>g w<br>r a<br>osi | must<br>Hori e r<br>d ine o<br>ugl r u<br>d b<br>orgi l<br>s e<br>iawf<br>u<br>al | heat<br>roost o o<br>a ri r<br>gas d t<br>p ilgu u<br>u r<br>adventure |

As such, an invention has been described in terms of a preferred embodiment thereof which fulfills each and every one of the objects of the invention as set forth hereinabove and provides a new and improved board game of great novelty and utility.

Of course, various changes, modifications and alterations in the teachings of the present invention may be contemplated by those skilled in the art without departing from the intended spirit and scope of the present invention. As such, it is intended that the present invention only be limited by the terms of the appended claims.

I claim:

1. An improved board game comprising:

(a) a game board having a multiplicity of spaces thereon, including:

i) blank spaces;

ii) spaces with a design thereon;

iii) spaces with a plurality of arrows thereon for indicating directions in which words may be created including a space including said arrows; and iv) spaces including indicia thereon, said indicia being provided for multiplication of scoring during play;

(b) a multiplicity of instruction means each having instructions thereon as to manner of play;

(c) three sets of tiles, each set including a multiplicity of tiles, said tiles further comprising:

i) a first set of tiles, each tile in said first set of tiles having a letter and a number on a face thereof;

ii) a second set of tiles, each tile in said second set of tiles having a number and a blank portion on a face thereof; and iii) a third set of tiles, each tile in said third set of tiles comprising a final play tile having a word or expression on a face thereof;

iv) whereby each of said tiles in said first second and third sets of tiles have said design on an opposite face thereof; and, (d) said multiplicity of final play tiles consisting of tiles which may be randomly drawn by said players at conclusion of play of said game, each of said final play tiles, when drawn by a player, aiding in determining final scoring based upon the said word or expression;

(e) whereby a plurality of players may play said game by selectively dividing the tiles from said first and second sets of tiles between them, and one at a time, first using some of said tiles from said first and second sets of tiles to form a word and thereafter picking a said instruction means and following the said instructions thereon, with each player picking at least one tile of said third set of tiles during a final play portion of said game.

2. The invention of claim 1, wherein said design comprises a caricature of a head.

3. The invention of claim 1, wherein said indicia for multiplication of scoring comprises a number and a multiplication sign which allows a player forming a word on spaces including a space including said indication to multiply a score obtained for so forming said word by the indicated multiplication factor.

* * * * *